US005210957A

United States Patent [19]

Weidener

[11] Patent Number: 5,210,957

[45] Date of Patent: May 18, 1993

[54] SYSTEM, APPARATUS AND METHODS FOR THE CONSERVATION OF FIBROUS MATERIAL

[76] Inventor: Marilyn Kemp Weidener, 612 Spruce St., Philadelphia, Pa. 19106

[21] Appl. No.: 719,374

[22] Filed: Jun. 24, 1991

[51] Int. Cl.[5] ..... F26B 5/04

[52] U.S. Cl. ..... 34/15; 34/92; 34/82; 34/60

[58] Field of Search ..... 34/29, 22, 233, 92, 34/15, 16, 82, 12, 60

[56] References Cited

U.S. PATENT DOCUMENTS 1,094,195 4/1914 Butts ..... 34/29

4,249,992 2/1981 Wells ..... 34/54

*Primary Examiner*—Henry A. Bennett
*Assistant Examiner*—Denise L. Gromada
*Attorney, Agent, or Firm*—William E. Hedges

[57] ABSTRACT

A system, apparatus and methods are described for the treatment of fibrous materials and, in particular, works of art on paper, with aqueous treating fluids introduced to a treatment chamber by means of an ultrasonic humidifier creating contact between the fibrous materials being treated and an absorbent material beneath it through air pressure, and drawing filtered air through the material being treated to dry the material by means of an underlying vacuum.

3 Claims, 3 Drawing Sheets

FIG. 3
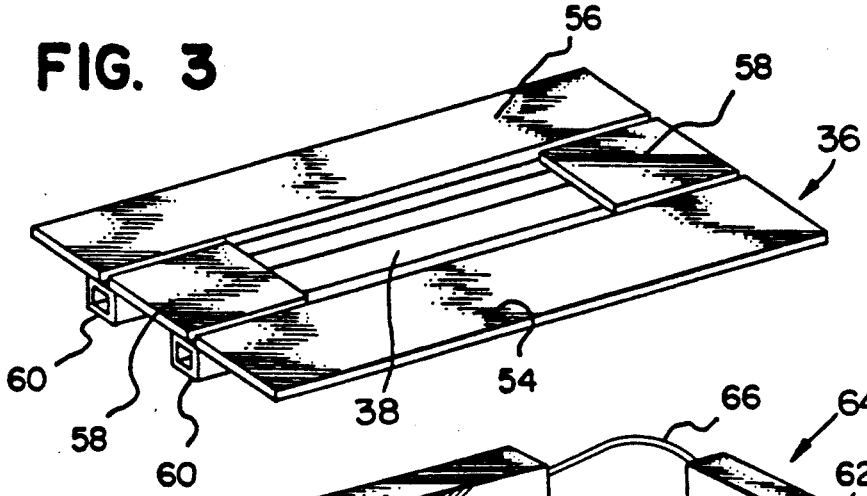
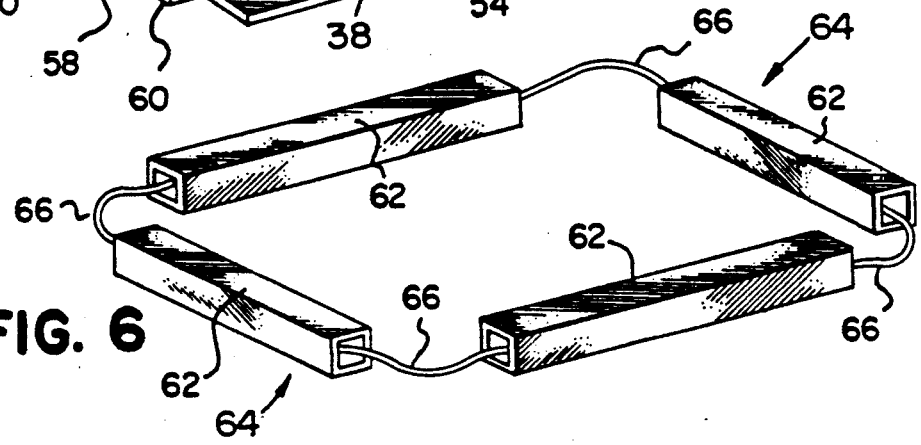
FIG. 6
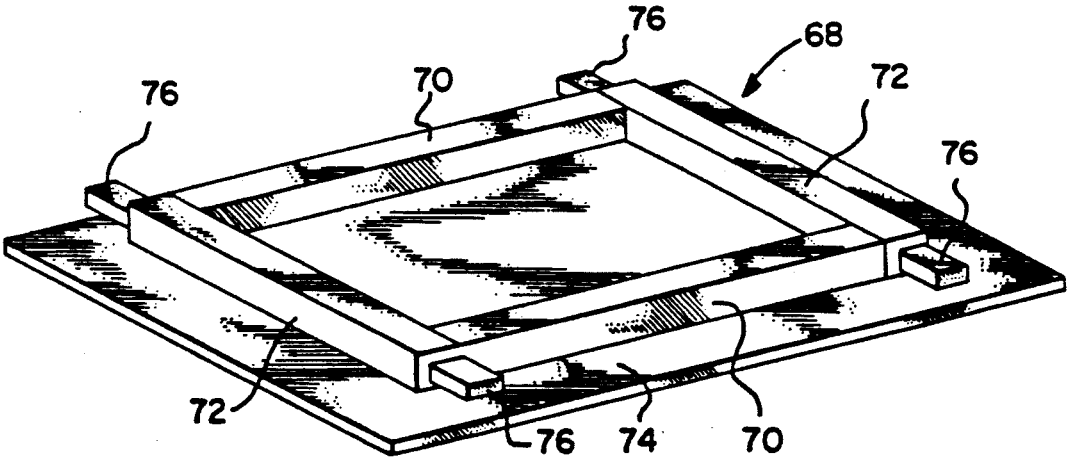
FIG. 5

SYSTEM, APPARATUS AND METHODS FOR THE CONSERVATION OF FIBROUS MATERIAL

The present invention relates broadly to the treatment of fibrous materials, and especially to the treatment of cellulosic fibers and paper; and, in particular, works of art on paper.

BACKGROUND AND PRIOR ART

The art of conservation of paper, including books, prints and other works of art on paper is very old and many techniques are known to those skilled in the art. Indeed, the present applicant has previously developed a suction table to facilitate the conservation of works of art on paper, which is widely employed by paper conservators, and upon which the present invention is an improvement.

As will appear in more detail below, the prior art has employed a separate treatment or humidity chamber and apparatus with a suction or vacuum table to which the work piece is transferred after wetting to draw water through a paper or other fibrous article to be treated to remove stains, acids or other deleterious or defacing materials. However, the methods of the prior art have been disadvantageous, since they employed spray techniques to apply the aqueous treating fluids to the work piece. Such methods of application tended to cause over wetting and dripping, which could cause the irregular penetration of stains into the work piece with consequent damage. Moreover, with spray application techniques of the prior art, it has been difficult to achieve controlled uniform wetting of the work piece or controlled slow drying of the work piece from the lower surface to the upper surface thus preventing migration of any stains or other deleterious materials toward the upper surfaces of the material being treated.

It has been apparent, therefore, that a need has existed in the art to overcome these disadvantages.

It is an object of the present invention, therefore, to provide a system, apparatus and methods for the controlled uniform wetting of a work piece with a treatment fluid in such a way that the fluid does not drip through the work piece carrying stains or other deleterious materials into the work piece.

It is another object of the invention to provide for the controlled slow drying of the uniformly wetted work piece from the lower to the upper surface thereof, thus preventing stains or other deleterious material from migrating towards the upper surface of the material being treated.

It is another object of the invention to provide for the drying of the work piece using air pressure only without touching the surface of the fibrous material which may contain highly water soluble and friable media that would be damaged if any other pressure was applied. These and other objects of the invention, which will become apparent below, are achieved as described below.

SUMMARY OF THE INVENTION

The crux of the present invention, is the discovery of means for introducing the aqueous fluid treating agent to the treating zone and into contact with the material to be treated in a controlled and uniform manner, thus preventing over wetting of the material with consequent dripping of the treatment fluid through the work piece. Another major advantage of the invention is that the controlled and uniform wetting of the work piece permits controlled and uniform slow drying of the work piece from the lower surface thereof upward, thus preventing migration of stains or other deleterious materials upward toward the upper surface of the work piece. Other advantages are to prevent solubilizing or other changes in the media (watercolor, pastel) on the surface of the material (paper) and to prevent changes in the texture on the surface of the materials (paper). The invention also permits slow expansion of the material so that when the vacuum is turned on the piece is relaxed and flat and creases are not formed during flattening and drying.

The invention accomplishes these previously unobtainable objects by substituting an ultrasonic humidifier for the previously employed spray means for introducing the aqueous treating fluid to the treatment zone or chamber to contact the work piece. In this manner, both uniform and controlled wetting of the work piece and uniform and controlled slow drying of the work piece are made possible. This is accomplished without the time interval, during which the piece loses moisture, between the wetting up and drying steps that previously occurred when spray wetting or humidification in a separate chamber. While stains or other deleterious material must be allowed to move downward in the work piece being treated, and out of the fibrous material and support, if the stains cannot be removed for one reason or another they must not be allowed to move upward as the work is dried. In this way the damage which tended to occur in the treatments of the prior art is avoided.

The apparatus and methods of the invention, which implement the basic concepts of the system and combination of apparatus recited above will be described only briefly below, since the individual components of the novel system are known, per se.

A preferred embodiment of the invention, which is illustrative of many others, which will be apparent to those skilled in the art from the description of the invention herein, is illustrated, partially schematically, in the accompanying drawings, in which:

BRIEF DESCRIPTION OF THE DRAWINGS

FIG. 3 is a perspective detail view of the removable base of the moisture chamber;

FIG. 5 is a detailed view of a strainer element of the frame of FIG. 4; and FIG. 6 is a detailed view of a hoop forming part of the frame of FIG. 4.

DETAILED DESCRIPTION OF THE INVENTION

Figure 1:
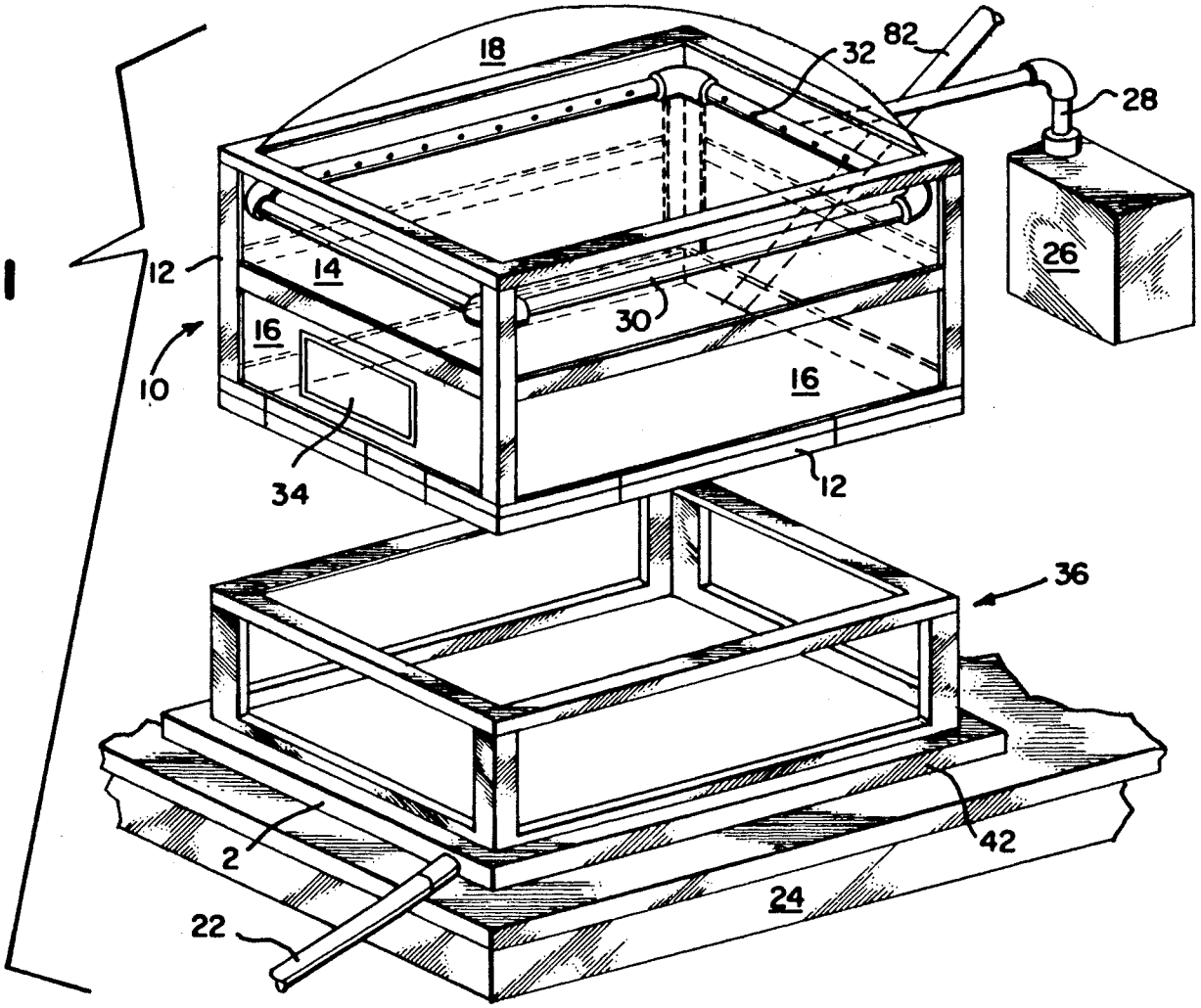
FIG. 1 is an exploded perspective view of a typical system and apparatus of the present invention including a moisture treatment chamber, a suction table, an optional intermediate support means, an ultrasonic humidifier, an optional removable base for the moisture chamber, and a mist entry and distribution system.

Referring now to the drawings, FIG. 1 shows a moisture treatment chamber 10 having a frame 12 composed of any suitable material such as plexiglas, aluminum or the like and having walls 14, which are preferably transparent. The moisture chamber 10 is also provided with one or a plurality of doors 16 for entry and removal of work pieces to be treated. The doors 16 are preferably provided on at least the front and lateral sides of the chamber 10, although any suitable number of doors may be provided on all sides for full access. The doors 16 are shown hinged, but may be made removable if desired. The doors 16 are provided with suitable latch means, not shown, which may be magnetic tape, magnetic latches, "Velcro" closures or mechanical latches. Suitable handles or knobs may also be provided on the doors. The moisture chamber 10 also includes a removable dome 18 which is also preferably transparent.

A suction table 20 having a hose 22 connected to a vacuum pump, not shown, is supported on a table or laboratory bench 24.

Moisture is supplied to the moisture or treatment chamber from an ultrasonic humidifier (USVH) 26 through any suitable connecting means such as pipe 28 and mist entry and distributor pipe 30. The mist from the ultrasonic humidifier 26 flows through pipe 28 and is discharged uniformly into the treatment chamber through the mist entry ports 32 in the pipe 30. As will be seen in FIG. 1, the mist distributor pipe 30 extends around the upper interior periphery of the chamber 10 to provide uniform distribution of the mist throughout the treatment chamber. Water or other aqueous treating fluid is contained in a well in the humidifier 26.

An air filter 34 is mounted in one wall 14 or in any other suitable location in the treatment chamber 10 to permit entry of clean air to the treatment chamber. Any suitable air filter or system for air filtration may be employed; a suitable type being a common automobile carburetor filter. If separately connected, the specific high efficiency particle arresting filter (HEPA) available from Honeywell Corporation may also be employed. Other suitable filters are commercially available.

An optional removable base 36, shown in greater detail in FIG. 3, having a central opening 38 may be inserted below the treatment chamber 10.

The air intake filter provides intake of sufficient filtered air to equal the volume of air being evacuated from the system by the suction table and vacuum pump in order to maintain an essentially null condition in the system, although there may be a slight pressure differential between the treatment chamber and the vacuum. The walls and dome of the chamber may be of transparent material such as glass, Plexiglas, or the like to permit viewing the work piece.

The suction table 20 is, of course, disposed below the moisture chamber 10. The suction table 20 as shown in FIG. 1 is entirely closed around its perimeter and bottom except for the connection to the hose 22 to the vacuum pump. The peripheral edges 42 of the suction table 20 may suitably be aluminum channel elements connected in any conventional way.

Figure 2:
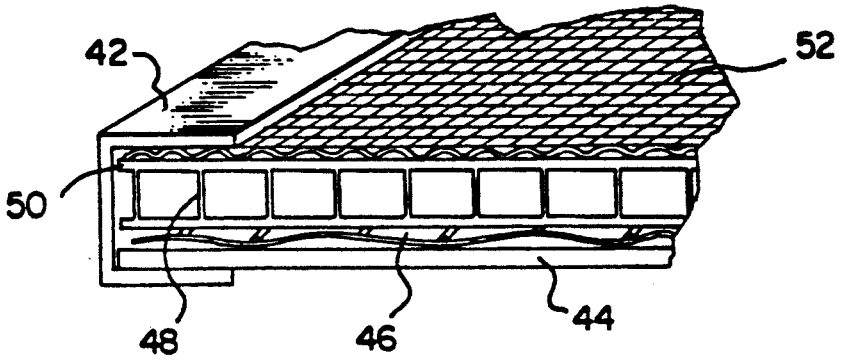
FIG. 2 is a cross-sectional view of the suction table taken on the line 2—2 of FIG. 1.

As shown in FIG. 2 the frame of the suction table 20 which is made up of the channel edges 42 contains a sandwich composed of a lower layer 44 suitably of acrylic sheet, above which is a woven wire screen 46, suitably having ½" openings. Above the screen 46 is disposed a spacing element 48 which may suitably be a plastic egg crate having large apertures and substantial thickness, suitably ½". A second wire screen or mesh 50 is disposed above the spacer 48; suitably of smaller mesh than screen 46, such as ⅛". The top layer of the sandwich, which overlies screen 46, is suitably a 50 mesh stainless steel cover layer 52 or the equivalent. The foregoing dimensions of the elements of the sandwich in the suction table 20 are, of course, only preferred and other suitable equivalent elements may be employed.

FIG. 3 shows a removable temporary floor element 36 which slides into the below the moisture chamber 10 to facilitate a reverse moisture suspension wetting technique to be described in detail below. The temporary floor or removable base element 36 has front and rear elements 54 and 56, and two end elements 58 which slidably fit together to form and surround the opening 38 which is dimensioned to the size of the work piece to be treated. These elements are suitably supported by and connected to a pair of Plexiglas tubes 60. The elements 54, 56 and 58 are suitably of ¼" thickness and the tubes 60 of ¾" thickness. The end elements 58 slide between the front and rear elements for size adjustment.

Figure 4:
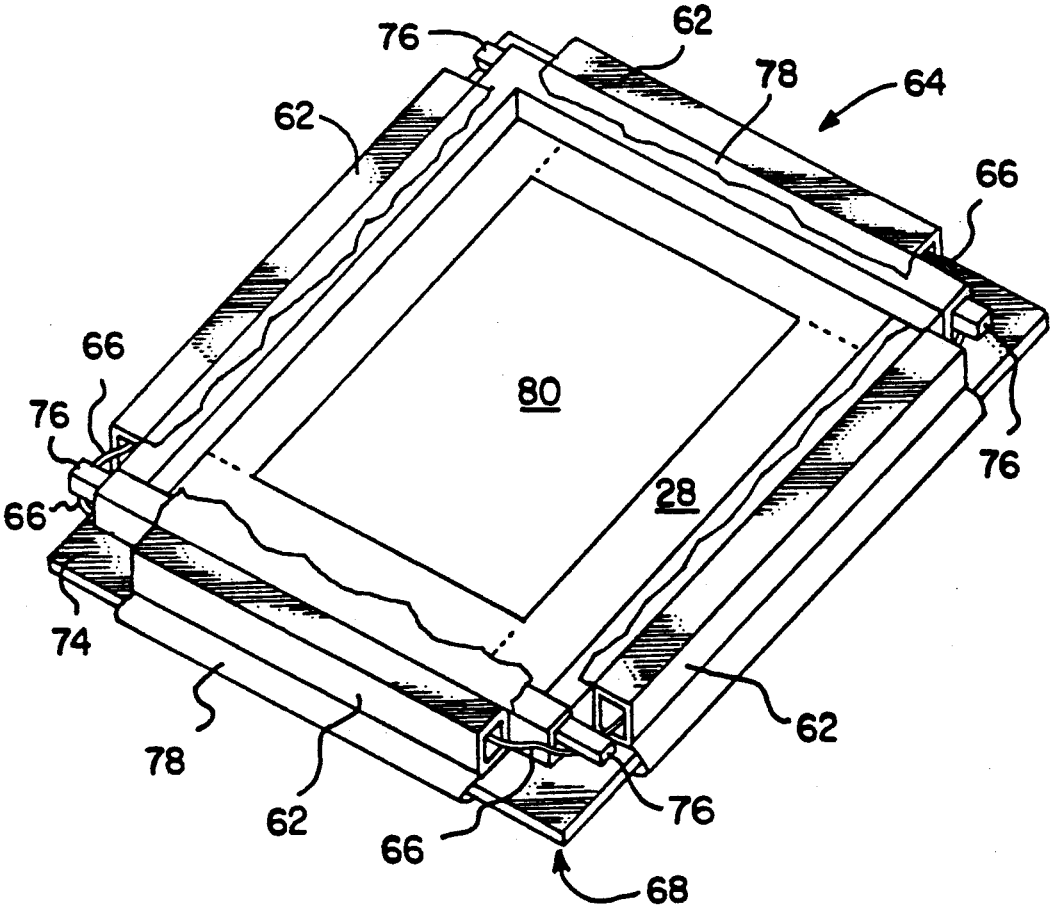
FIG. 4 is a perspective view of a rigid frame for mounting a work piece.

FIGS. 4, 5 and 6 show a rigid frame and elements thereof for holding a work piece to be treated. The frame is made up of Plexiglas tubes 67 and forming a hoop element 64 held together by an elastic band 66 extending through the tubes 62. The frame of FIG. 4 also includes a rigid base strainer element 68 having a raised central retaining structure composed of two rods 70 and two rods 72 fastened together to form a frame and mounted on the base 74 of the strainer 68 the rods 72 have extensions or hooks 76, as shown in FIGS. 5 The hoop 64 of FIG. 6 fits around the frame elements 70 and 72 of the strainer 68 and are held there against by the tension of the elastic 66 which passes through the tubes 62 and under the hooks or extensions 76 of the rods 72. The purpose of this structure is to clamp and hold a sheet of Japanese paper 78 which supports a work piece 80 to be treated.

General Discussion of the System, Apparatus and Methods

As will be apparent from the foregoing, the doors 16 are positioned so that the conservator can conduct treatments under controlled moisture conditions. The moisture chamber 10 is set on the suction table 20, moisture is introduced by means of an ultrasonic humidifier 26 and removed through the suction table 20. A technique for stain removal and lining a work piece within the chamber will be described below.

Water is probably the most important chemical used in the conservation treatment of works of art, historic artifacts, and library and archival materials on cellulosic supports. It is used to relax cockled paper and wrinkled textiles so they can be flattened. Many stains and discolorations require the use of water if they are to be removed or reduced. Water is also used to formulate, apply and remove many adhesives especially in mending, hinging and lining. Bleaches and most deacidification agents are water based. Many sizes on paper are water soluble. Media applied to paper and dyes used on textiles may be formulated in water and/or remain water soluble after their application. Excessive moisture in the atmosphere in which the artifact exists, or lack of it, disastrous floods and accidental leaks can cause severe damage and deterioration. Water allows the conservator to treat and preserve fibrous and, particularly, cellulosic materials but the manner in which the water is used must be carefully controlled by the conservator.

Moisture is introduced into the chamber by means of a superfine, cool mist ultrasonic vapor humidifier. The moisture levels in the chamber can be maintained during subsequent, often lengthy, treatments at a desired humidity or the object can be thoroughly wetted. No moisture condensation on the ceiling or walls of the chamber has been observed. When the moisture chamber is placed over a suction table the wetted object can be slowly dried by withdrawing the moisture from the chamber through the suction table.

The treatment chamber of the invention is built to fit over the suction table since this allows for containment of the moisture within the chamber; controlled withdrawal of the moisture from the chamber through the suction table using a vacuum pump and a filter to clean the air passing through the system. The treatment chamber may suitably be constructed of ⅛" Plexiglas, reinforced with Plexiglas rods, and cemented and sealed at the joints. The dome section can be lifted by hand or a pulley system or doors 16 opened to permit the object to be placed on the table, the dome then lowered and the doors closed to form a closed container. When the doors are closed and the vacuum of the suction table is in operation the air enters the chamber through the air filter or a separate air filtration system.

The doors in the chamber allow the conservator(s) access to the entire space within the chamber so that the paper support can be manipulated during flattening, or so that chemicals for localized stain removal can be easily applied. A slow, controlled drying process helps prevent the migration of stains to the surface of the paper support when the stains cannot be removed (usually because of the sensitivity of the media).

The moisture chamber can be used independently of the suction table for humidification, especially during lengthy treatments, and for more even wetting of an object than is possible with spray wetting by hand. However, the combination of ultrasonic humidification in a moisture chamber and using the suction table offers the conservator an alternative (often easier and safer) treatment method for flattening, stain removal, and lining of delicate and water sensitive objects on porous supports.

The role of the suction table is to allow the conservator to dry the object from the reverse side of the sheet. Changing the blotters beneath the object during drying is usually needed on perpendicular flow tables. Earlier tables only allowed air flow through the artifact while "parallel" flow tables introduce a great deal of air at controlled leaks under the table surface so that there is a constant "breeze" for drying liquids from the bottom of the blotter. This ability to remove moisture and dry the sheet from below becomes especially important in stain removal and during lining on the suction table.

The suction table has proven to be a useful tool that is an alternative to more traditional methods of treating works of art and artifacts with porous supports. It allows for more control where the conservator is able to stop in mid-treatment if there is any indication of movement of colors or other problems.

Because many of the objects that would be treated on the suction table are of a very delicate nature and often water sensitive the control of moisture during treatment is of major importance. Humidification and careful spray wetting have often been used previously. However, maintaining the moisture content of the object during the lengthy time periods sometimes required for treatment has been a problem. To solve this problem the present invention provides a chamber with access openings, so the conservator(s) can work within the chamber. The moisture can be controlled and maintained at a level consistent with the needs of the particular object under treatment. By placing the chamber over the suction table and introducing moisture into the chamber by means of a cool mist, ultrasonic vapor humidifier (USVH) the conservator can work for extended periods of time without worrying about the drying out of the object and the need to re-wet during treatment.

An ultrasonic vapor humidifier shoots water vapor into the closed chamber. The work piece can be wetted to an appropriate degree or simply humidified in order to relax the paper support. When the vacuum pump beneath the porous top of the suction table is turned on the moisture in the closed chamber and filtered air are drawn through the paper and exhausted outside the area, allowing for stain removal and flattening of the paper support.

The cool mist that the USVH provides can be allowed to build up until the interior of the chamber resembles a rain cloud. The virtue of the cool mist is that there is no condensation on the interior walls or ceiling of the chamber which tends to occur during normal humidification at elevated temperatures. However, water does condense on the plastic surrounding the object at the bed of the chamber. The moisture can be controlled to remain at a designated relative humidity or allowed to build up within the chamber. It is absorbed by the object and blotters within the chamber. As soon as the suction is turned on, the moisture is directed through the porous object and out through the vacuum pump. The USVH can be regulated so that the amount of moisture in the air passing through the table is sufficient to keep the object relaxed and damp during the length of the treatment and then, by slowly decreasing the mist entering the chamber, the object can be taken to dryness.

The most important improvement in the new chamber is the relatively air-tight construction of the chamber that allows the air intake to come through filtered openings other than the access openings when the doors 16 are closed. The doors, preferably on all four sides of the chamber, are hinged at the bottom edges and held closed at the other three sides with magnetic tape. An air-tight cover over the access is closed when access is not required such as the drying out part of the treatment.

DETAILED TREATMENT TECHNIQUES

The following is a description of the techniques used to remove stains from an unfixed pastel with badly distorted, stained, extremely weak paper support, to flatten the support, and to line it with Japanese paper and paste, using the system of the invention, including a moisture chamber on a suction table and an USVH.

A. Stain Removal

1. The bed of the suction table is marked to provide two open areas slightly larger than the object. The moisture chamber is placed on the suction table. The object is placed face-up on a sheet of Japanese paper to mitigate any undesirable texture in the blotters. Beneath the object, Japanese paper is preferable to the use of polyester web because it allows the stains to pass through into the blotters more effectively.

2. The USVH is turned on. The amount of mist entering the chamber is regulated by the conservator according to the treatment needs.

3. The object is thoroughly wetted, relaxed and expanded before the treatment is started.

4. Several layers of blotters and medium weight, smooth Japanese paper are thoroughly brush wetted until they are "sopping" wet.

5. These wet blotters and paper are placed over the second opening in the surface of the suction table next to the humidified object.

6. The object, supported by the Japanese paper, is lifted onto the wet blotters. Cover the first opening in the table with plastic.

7. The suction is turned on. Two openings are desirable to facilitate stain removal and drying out of the object.

8. Additional moisture is absorbed by the paper object from the wet blotters below. At this point deformations in the paper support can be manipulated out. The working time for this manipulation may be only a few minutes in order to avoid creasing.

9. To begin the drying and stain removal process dry blotters are placed over the first opening on the suction table which has again been uncovered.

10. The wet object, supported by the Japanese paper, is lifted onto the dry blotters. Stains will move from the wet object into the dry blotters below. Remove the wet blotters form the chamber and place plastic over the second opening int eh suction table.

11. If necessary to prevent irregular drying at the edges of the object, place polyester web strips up to or slightly over the outer edges of the object and weight with glass or plexiglass plates.

12. If the blotters become saturated with water or stains they can be replaced with a dry blotter.

13. In drying it is important to keep the top surface of the object damp while the moisture is being removed form below. Once the blotter beneath the object does not appear to be absorbing any further moisture the mist can be decreased gradually until no further moisture is entering the chamber and eventually shut off completely. The object can then be taken to dryness while under the continuing suction pressure.

14. If staining remains in the paper support the process can be repeated.

B. Lining with Japanese Paper and Paste

Follow Steps 1 through 3 for Stain Removal

4. The lining paper is placed over a sheet of polyester web and brushed out with paste. This step can be done outside the moisture chamber, if it is more convenient. The pasted lining paper supported by the polyester web is then placed over the second opening on the suction table.

5. If the humidified object is not flat at this time it must be flattened on the suction table before lining.

6. The flattened object, supported on the Japanese paper, is lifted and carefully slipped off the Japanese paper into the pasted lining paper.

7. The suction is turned on.

8. Additional moisture is absorbed by the object from the pasted lining paper below. Some manipulation may be necessary at this point if any bubbles or wrinkles form between the paper support and the lining paper.

Continue with steps 9 through 13 of Stain Removal

The treatment described above was carried out on a perpendicular flow suction table. If a parallel flow table is used, and the blotters dry from below because of the transverse air flow beneath the table surface there may be less, or no need for blotter changes. The USVH allows the top surface of the object to remain damp as the moisture is being removed and evaporated from the reverse. At the last moment the cool mist can be discontinued and the surface dried, preventing any staining remaining from migrating back to the surface of the object.

The treatment described above, is a difficult treatment and should only be attempted by an experienced conservator. Size limitations of both the suction table and moisture chamber will limit the size of objects that can be treated. The combination of wet blotters and ultrasonic vapor humidification in a moisture chamber on a suction table offers the conservator another alternative treatment method. Both the wet blotter technique and the USVH allow for a much more controlled use of moisture than previously available to the conservator with regular humidification chambers, stem generating humidifiers, water baths, float washing, spray and brush wetting and should allow for easier and safer stain removal and linings of delicate and water sensitive paper supported and other objects on porous supports.

Another and more general technique or method of the invention is as follows:

TREATMENT OF WATERCOLORS: WETTING AND FLATTENING

General Description

1. This technique requires the use of a moisture chamber/ suction table/ultrasonic humidifier/air filter system.
2. The surface of the suction table is masked with polyester film in which a window is cut just slightly larger than the paper being treated.
3. The creased watercolor sample is placed face-down on polyester web and blotter in the moisture chamber.
4. The ultrasonic humidifier is turned on to its maximum.
5. The amount of moisture that can be introduced into the paper is determined by the solubility of the media on the paper. In practice, a watercolor may be wetted on both obverse and reverse by turning the object face-up for short periods of time during the wetting-up process. Another technique might be to set the ultrasonic humidifier at a lower level of mist and to expose the watercolor for a longer period of time.
6. The paper support is tested (manually flexed) to determine if it is sufficiently relaxed to allow the paper to flatten under vacuum pressure.
7. When the paper is relaxed, the humidifier is turned off, the sample is turned face-up on polyester web and blotter over the opening in the mylar mask on the suction table.
8. The vacuum is immediately turned on and the paper is manipulated flat.
9. Long narrow weights are placed over the edges of the paper support to prevent the edges from drying too quickly and curling away from the suction table.
10. When the media is dry to the touch (as tested through a small piece of polyester web) the sample is allowed to complete the drying and flattening process between polyester web, blotters and felts, under glass and weights.

Still another method of the invention employs the embodiment of the apparatus including the removable base 36 as shown in FIG. 1 and in detail in FIG. 3.

Treatment of Pastels: Wetting and Flattening

General Description

1. This technique, which we call "reverse suspension wetting," requires the use of a moisture chamber/suction table/ultrasonic humidifier/air filter system. The moisture chamber is raised off the suction table and supported about six inches above its surface. A temporary floor 36, in four sections, 54, 56, is placed at the bottom of the raised moisture chamber. This floor has an opening 38 in the center the size of the piece to be treated and is easily removable during treatment. See FIG. 3.
2. The pastel is placed in a Japanese paper mat: four strips of a long-fibered Japanese paper are adhered to the reverse edges of the pastel paper support with wheatstarch paste and allowed to dry.
3. The pastel is secured by the mat in a rigid frame similar to an embroidery hoop.
4. The pastel, in its protective frame, is placed face-down over the opening in the temporary floor of the moisture chamber. A polyester film mask with a window slightly larger than the paper support of the pastel and a blotter are placed in readiness on the surface of the suction table below.
5. The ultrasonic humidifier is turned on: the mist remains in the moisture chamber, wetting the paper support from the reverse only and does not circulate below the chamber. The pastel itself, therefore, is not wetted, only the reverse of the paper support.
6. When the paper support of the pastel is sufficiently relaxed the humidifier is turned off. This point is determined by manually flexing the paper and through the experience of the conservator.
7. The pastel, still in the frame, is turned face-up and lowered onto the blotter on the opening in the mask of the suction table (part of the temporary floor of the chamber is removed at this time so the piece can be maneuvered down onto the suction table). Efficient maneuvering at this step to avoid the loss of moisture between the wetting-up and drying steps may be critical to the success of the flattening of the paper.
8. The frame is removed from the sample.
9. The vacuum is immediately turned on; the paper usually has to be manipulated flat in order to prevent creases.
10. Long, narrow weights are placed over the edges of the paper support to prevent the edges from drying too quickly and curling away from the suction table.
11. Following the initial flattening, the vacuum is turned off and the pastel is allowed to complete the drying process without vacuum pressure in place on the suction table with the edges of the sample weighted.
12. After the paper is completely dry the Japanese paper mat is cut off to the edges of the pastel.
13. On a trial run the time-factors for treatment of a pastel on Whatman paper were as follows:

| Treatment Procedure | Time | Duration |
|---|---|---|
| 1) Placed sample in Japanese paper mat | | 2 days before |
| 2) Secured matted sample in rigid frame | | c. 10 minutes |
| 3) Set up moisture chamber with removable bottom over suction table; blotter and polyester web placed over opening in mask on suction table | | c. 10 minutes |
| 4) Placed framed sample face down over opening in bottom of moisture chamber | 1:00.00 | |
| 5) Ultrasonic humidifier on | 1:00.00 | 5 mins. |
| 6) Ultrasonic humidifier off; turned sample face up, removed bottom of moisture chamber and lowered sample to polyester web/blotter on suction table; removed frame | 1:05.00 | 1 min. 9 secs. |
| 7) Vacuum on; manipulated sample flat, weighted edges | 1:06.09 | 44 secs. |
| 8) Vacuum off; left edges weighted to dry | 1:06.55 | 24 hrs. |
| 9) Removed weights; cut off Japanese paper mat | next day | |

The moisture chamber/suction table system also provides a means to use solvents other than water for the removal of appropriate stains, tapes and varnishes from fibrous materials such as works of art on paper. The fumes of the solvents are contained within the moisture chamber and may be used either with or without the mist from the ultrasonic humidifier. This system is used when a laboratory fume hood is not available. Preferably, however, these fumes are drawn off through hose 82 (FIG. 1) to a conventional explosion proof exhaust fan, not shown.

Solvents that might be used include acetone, ethanol, petroleum benzine and toluene among others. Because of their toxic and/or volatile nature these solvents must be removed from the work area. As with the mist from the ultrasonic humidifier, when using the suction table, the solvents are drawn through the paper into the blotter beneath the work carrying with it the solubilized stain or resinous material. However, the fumes of these solvents also evaporate from the surface of the stained material and must be removed from the chamber. This is done by inserting one end of a flexible hose through an opening in the side of the moisture chamber. The other end of the hose is connected to an explosion proof exhaust fan and the solvent is vented to the outside air.

Treatment of a varnished, hand-colored printed map: Removal of a discolored resin varnish from the surface.

GENERAL DESCRIPTION

1. The moisture chamber is placed over the map which is on a blotter on the suction table.
2. One end of a flexible hose (covered with a screening material) is inserted through an opening in the side of the chamber to a point as close to the work surface as possible. The other end of the hose is attached to an explosion proof exhaust fan.
3. A solvent that will solubilize the varnish is applied through the chamber door to the surface with a cotton swab, brush and/or an eye dropper. The varnish can be wiped off the surface with the cotton swab while varnish that has penetrated into the fibers of the material is drawn down into the blotter beneath the map by means of the vacuum beneath the surface of the suction table.
4. The dirty blotters are replaced with clean blotters as often as necessary.

5. The solvent is repeatedly applied until discoloration no longer is visible in the blotter beneath the map.

6. The chamber doors are closed and the exhaust fan is allowed to remain on until all the solvent fumes are evacuated from the chamber, the fibrous material and the blotter beneath.

What is claimed is:

1. In a system for the treatment of fibrous material, which comprises:

(a) an enclosed treatment zone;

(b) a vacuum zone disposed beneath said treatment zone;

(c) means between said vacuum zone and said treatment zone to support the fibrous material to be treated;

(d) means to provide a vacuum in said vacuum zone;

(e) means to introduce an aqueous treatment fluid to said treatment zone and to contact said fibrous material;

(f) inlet filter mans to permit filtered air to enter said treatment chamber and pass through said fibrous material into said vacuum zone;

(g) the improvement which comprises;

(h) employing an ultrasonic humidifier means to introduce said treatment fluid to said treatment zone and to further apply said treatment fluid to said fibrous material to be treated in a controlled and uniform manner thus preventing dripping of said treatment fluid through said material being treated.

2. The system of claim 1, wherein said means to support said fibrous material absorbs treatment fluid passing through said fibrous material into said vacuum zone thus preventing said treatment fluid from migrating toward the upper surface of material being treated.

3. Apparatus for the treatment of fibrous material which comprises in combination:

(a) a treatment chamber;

(b) a vacuum table disposed beneath said treatment chamber;

(c) absorbent means between said vacuum chamber and treatment chamber to support the fibrous material being treated;

(d) a source of vacuum connected to said chamber;

(e) an ultrasonic humidifier connected between said treatment chamber and a source of aqueous treatment fluid to introduce treatment fluid to said treatment chamber and into contact with said material being treated so that said material is uniformly wetted in a controllable manner; and (f) inlet filter means connected to said treatment chamber to introduce filtered air thereto and permit said air to pass through the material to be treated into said vacuum chamber in order to dry the material being treated.

* * * * *